United States Patent [19]

Pfeifer et al.

[11] 4,082,580

[45] Apr. 4, 1978

[54] IRON-NICKEL-MOLYBDENUM ALLOY HAVING IMPROVED STABILITY AND HIGH INITIAL PERMEABILITY

[75] Inventors: Friedrich Pfeifer, Hanau; Günter Klein, Weinheim, both of Germany

[73] Assignee: Vacuumschmelze GmbH, Hanau, Germany

[21] Appl. No.: 519,721

[22] Filed: Oct. 31, 1974

Related U.S. Application Data

[63] Continuation-in-part of Ser. No. 298,690, Oct. 18, 1972, abandoned, which is a continuation-in-part of Ser. No. 55,569, Jul. 16, 1970, abandoned.

[30] Foreign Application Priority Data

Aug. 12, 1969 Germany ..... 1940923

[51] Int. Cl.[2] ..... C04B 35/00

[52] U.S. Cl. ..... 148/31.55; 75/123 K; 148/120; 148/121

[58] Field of Search ..... 148/31.55, 120, 121; 75/123 K

[56] References Cited

U.S. PATENT DOCUMENTS

| | | | |
|---|---|---|---|
| 1,757,178 | 5/1930 | Elmen | 75/123 K |
| 2,147,791 | 2/1939 | Holst et al. | 148/31.55 |
| 2,930,725 | 3/1960 | Clark | 75/123 K |
| 3,546,031 | 12/1970 | Pfeifer et al. | 148/108 |
| 3,657,026 | 4/1972 | Colling | 148/120 |

FOREIGN PATENT DOCUMENTS

| | | | |
|---|---|---|---|
| 1,043,369 | 11/1958 | Germany | 148/121 |

*Primary Examiner*—Walter R. Satterfield
*Attorney, Agent, or Firm*—R. T. Randig

[57] ABSTRACT

An alloy is described which contains between about 33 and 35% nickel, about 1 and 4% molybdenum and the balance iron with incidental impurities. The alloy is characterized by having a completely secondarily recrystallized structure, improved stability preventing substantial transformation to martensite at temperatures as low as −320° F, high resistance and high initial permeability.

3 Claims, No Drawings

IRON-NICKEL-MOLYBDENUM ALLOY HAVING IMPROVED STABILITY AND HIGH INITIAL PERMEABILITY

The present application is a continuation-in-part of application Ser. No. 298,690 filed Oct. 18, 1972 and now abandoned, which in turn was a continuation-in-part of application Ser. No. 55,569 filed July 16, 1970, now abandoned.

BACKGROUND OF THE INVENTION

1. Field of the Invention

The present invention relates to a magnetic material which is particularly suited for use in low-current transmission engineering. This magnetic material has improved stability preventing transformation to the martensitic phase and a high initial permeability.

2. Summary of the Prior Art

Metallic materials which are characterized by an ease of magnetization, and which exhibit a high permeability at low field strength are particularly useful in low current transmission engineering. In particular, such materials find considerable use from the space saving standpoint for example, in transmitters, a high inductivity can be obtained employing a relatively small number of turns. Thus, the primary pre-requisite in communication engineering is for magnetic material to exhibit a high initial permeability.

In addition, these magnetic materials must also possess a high degree of stability so that the magnetic characteristics are stable over the temperature range of intended operation. Moreover, depending upon the mode of the functioning of the magnetic materials additional requirements must be met before the materials can be successfully employed. Commensurate in this regard, a high specific electrical resistance is needed in order to keep the eddy current loss component as small as possible, at the dimensions of the material employed.

The highest permeability alloys within the iron-nickel-molybedenum composition include from 70 to 80% nickel; however, these alloys are unsatisfactory from the eddy current standpoint. A further disadvantage of these materials as well as the other known high permeability alloys containing 45 to 65% nickel concerns the aspect that the most favorable permeability values are obtained only when the heat treatment processes carried out for this purpose are performed with the very greatest of care.

In addition to the foregoing two groups of materials, there are also known the binary nickel-iron alloys which contain 32 to 40% nickel, and more particularly 35 to 37% nickel. These alloys have a relatively high initial permeability, and in addition, they have a relatively very high specific resistance. This latter aspect is more clearly set forth in German Pat. No. 1,273,210, and Technical News Krupp, Research Report Volume 23, 1965, page 101; FIG. 8. Since these alloys were produced with sufficiently high purity, resulting from smelting in an extremely high vacuum, permeability values $\mu_5$ of more than 20,000 Gauss/oersteds were obtained at a magnetic field of 5 mOe. Such binary nickel-iron alloys have not only the disadvantage that the necessary degree of purity can be obtained only at great expense, but in addition, such binary alloys are not stable and readily transform to martensite to any satisfactory degree. A comparison of the binary phase diagram of the iron-nickel alloy system can be found, for example, in the publication by E. Houdermont, Handbook of Special Steel Science, 3rd edition, 1956, at page 552. The 35% nickel-iron alloy undergoes the martensitic transformation of gamma to alpha at a temperature of −100° C, a temperature which is nearly 100° C above that of liquid nitrogen and which is above the temperatures often encountered in cryogenic applications of such material.

SUMMARY OF THE INVENTION

Contrary to the prior art experience, the alloy of the present invention has been surprising from the standpoint that where the nickel content is maintained between 33 and 35%, the molybdenum is maintained within the range between about 1 and 4% molybdenum and by limiting the total processing and deoxidizing additives to a maximum of 1% with the balance essentially iron, an alloy is obtained which is stable from transformation at the temperature of liquid nitrogen, possesses a high resistance and exhibits a high initial permeability. These alloys having the foregoing composition are hot worked, annealed and cold worked to finish gauge. The alloy after heat treating possesses a secondarily recrystallized structure, such structure occurring by heat treating the alloy, after cold working the material to its desired final gauge, such cold working effecting at least a 92% reduction in cross-sectional area and preferably in excess of about 96% reduction in cross-sectional area, by heating the material in a non-oxidizing atmosphere for a time period of 5 to 10 hours at a temperature in the range of between 1050° C and 1250° C and more specifically at a temperature in excess of about 1150° C. In addition, an intermediate anneal after hot working and prior to cold working is favorable to provide a sufficiently fine grained structure. This anneal is performed at a temperature between the recrystallization temperature and about 700° C.

DESCRIPTION OF THE PREFERRED EMBODIMENT

Reference may be had to the following examples which clearly demonstrate the outstanding characteristics obtained in the above described alloy. The alloys were vacuum melted at a pressure of about 0.05 Torr, and have compositions set forth in the following table:

MAGNETIC ALLOYS WITH IRON-NICKEL BASIS

| Alloy No. | Composition in % by weight | | | | Initial Permeability $\mu_5$ at 25° C | |
|---|---|---|---|---|---|---|
| | Nickel | Molybdenum | Manganese | Iron*) | | |
| | | | | | | G/ |
| 75 | 34.6 | 0 | 0.3 | rest | 17,000 | Oe |
| 79 | 34.6 | 1.0 | 0.4 | rest | 24,000 | " |
| 83 | 34.5 | 1.9 | 0.4 | rest | 38,000 | " |
| 84 | 35.5 | 2.0 | 0.4 | rest | 14,000 | " |

*)iron with 0.02 to 0.03% silicon

Each of the alloying compositions when cast into ingots were hot worked to a thickness of 2.5 millimeters. Subsequently, the hot rolled band was given an intermediate heat treatment at 700° C and finally cold worked to a finished thickness of 0.1 millimeters in thickness. Following slitting to a width of 10 millimeters, the strips obtained were wound into ring cores having an outside diameter of 35 millimeters and an inside diameter of 10 millimeters. Such wound cores were then subjected to a heat treatment in dry hydrogen at a temperature of 1200° C for 10 hours. The heat treatment produced a structure in all of the alloys which were completely secondarily recrystallized.

The permeability at 5 mOe of the ring cores thus produced was determined by a ferrometer at a field density of 5 mOe, and a frequency of 50 Hertz. This corresponds to practically initial permeability of these alloys. The initial permeability values of $\mu_5$ at 5 mOe obtained at 25° C are listed in the above table in the last column.

It has been found that from an initial permeability standpoint, the nickel content is highly critical. Thus where the nickel is maintained within the range between about 33 and 35% a well defined peak in the initial permeability is attained at a temperature within the range between about 0° C and 60° C. However, if the nickel content is raised to about 37%, the peak in the initial permeability vs. temperature curve occurs at about 120° C. Accordingly, the nickel content must be controlled to the range between 33 and 35%. Molybdenum also raises this peak.

From the test results it can be seen that increasing the molybdenum content to more than 1% has produced great improvement in the initial permeability. Where approximately 1.9% molybdenum is present, the initial permeability is increased to a value of 38,000 Gauss/oersteds. more than twice the amount of the alloy without molybdenum. This is considerably in excess of the initial permeability value of the previously mentioned binary nickel-iron alloys.

It will be appreciated that the test results set forth hereinbefore were obtained in alloy which in the final heat treated condition were characterized by a substantially secondarily recrystallized structure. In order to obtain such a secondarily recrystallized structure, the following conditions were found necessary:

1. The hot worked condition of the alloy, prior to the commencement of cold working must have a fine grained structure either resulting from a high hot working finishing temperature or the material was subjected to a heat treatment following hot working in order to attain the fine grain structure.

2. Prior to the final heat treatment, the cold working to finish gauge must effect a reduction in cross-sectional area of in excess of about 92% and preferably in excess of 96%.

3. The final heat treatment is conducted at a sufficiently high temperature in order to produce a substantially completely secondarily recrystallized structure. With the foregoing criteria met, and the composition controlled as set forth hereinbefore, the alloy will exhibit a room temperature initial permeability of at least 20,000 Gauss/oersted.

Advantageously, the nickel-iron-molybdenum alloy of the present invention also has higher specific resistance than corresponding material without molybdenum. Thus, the alloy with 1.9% of molybdenum listed as alloy 83, has a specific resistance of 0.92 ohm - millimeter square per meter which is a resistance improvement of about 8% over that of a nickel-iron alloy without molybdenum and having the same content of nickel.

It will be appreciated that while the alloy of the present invention may contain up to 1% deoxidation and workability improving elements silicon and manganese, the presence or absence of such processing and deoxidizing additions has no effect on the novel characteristics of the present alloy. These elements are normally added to nickel-iron alloys in a total amount of up to 1% by weight. These elements perform the function of deoxidizing the melt and improve the workability and their effect on the martensitic transformation characteristics and on the secondary recrystallization, if any is de minimus. Moreover, these elements have no discernable effect on the magnetic characteristic exhibited by the alloy. Accordingly, the presence or absence of these elements in the alloy of the present invention concept is immaterial.

The alloys of the present invention were cooled to the temperature of liquid nitrogen and remain stable without any material transformation from the austenitic phase to the martensitic phase. On the contrary, the binary iron-nickel alloy with 33.4% of nickel when cooled to the same temperature, immediately underwent the martensitic transformation. Thus, in the temperature ranges encountered the alloy of the present invention is suitable for use in any object which must have a high initial permeability, substantial stability and a high specific resistance such uses including applications as transmitters, instrument transformer and magnetic shields.

We claim:

1. A heat treated magnetic alloy consisting essentially of from 33 to 35% nickel, from 1 to 4% molybdenum and the balance essentially iron the alloy prior to the last cold working exhibiting a fine grain structure and after the final heat treatment exhibiting a completely secondarily recrystallized structure, an initial permeability in excess of 20,000 Gauss/oersted and stability preventing substantial transformation to martensite at temperatures of −320° F.

2. The alloy of claim 1 having a completely secondarily recrystallized structure after heat treating the alloy which has been cold worked to effect at least a 92% reduction in cross-sectional area, at a temperature within the range between 1050° C and 1250° C in a non-oxidizing atmosphere.

3. The alloy of claim 2 in which the alloy is given an intermediate anneal at a temperature within the range between the recrystallization temperature and 700° C prior to cold working.

* * * * *